US006910921B2

(12) United States Patent
Pan et al.

(10) Patent No.: US 6,910,921 B2
(45) Date of Patent: Jun. 28, 2005

(54) ELECTRICAL CONNECTOR

(75) Inventors: Wei-Hua Pan, Kunsan (CN); Zhong-Hua Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/923,572

(22) Filed: Aug. 20, 2004

(65) Prior Publication Data

US 2005/0042926 A1 Feb. 24, 2005

(30) Foreign Application Priority Data

Aug. 20, 2003 (TW) ..... 92215077 U

(51) Int. Cl.[7] ..... H01R 13/648

(52) U.S. Cl. ..... 439/607; 439/74; 439/108

(58) Field of Search ..... 439/607, 74, 108

(56) References Cited

U.S. PATENT DOCUMENTS 6,042,398 A * 3/2000 Wu et al. ..... 439/101
6,095,824 A * 8/2000 McHugh ..... 439/74
6,551,139 B1 * 4/2003 Yu ..... 439/607
6,726,492 B1 * 4/2004 Yu ..... 439/108

* cited by examiner

*Primary Examiner*—Tho D. Ta
(74) *Attorney, Agent, or Firm*—Wei Te Chung

(57) ABSTRACT

An electrical connector (1) includes an elongate insulative housing (10), a number of contacts (20), and a shell (30). The insulative housing has a bottom wall (11) and two side walls (12) extending upwardly from the bottom wall. The contacts include signal contacts (21) and grounding contacts (22). Each contact has an engaging portion received in the insulative housing and a soldering portion extending outwardly and horizontally from the bottom wall. The shell is assembled to exterior surfaces of the side walls and comprises a plurality of grounding fingers (31) and a pair of cut portions (33). A distant is existed between a bottom surface of the bottom wall and each cut portion.

1 Claim, 4 Drawing Sheets

(PRTOR ART)

ELECTRICAL CONNECTOR

BACKGROUND OF THE INVENTION

1. Field of the Invention

The present invention relates to electrical board-to-board connector, and more particularly to the high speed connector assembly having an improved shell for achieving a good performance.

2. Description of the Related Art

With the development of the technology, the electrical devices need to reduce sizes to meet the miniature trend. Accordingly, the electrical connectors are also becoming more and more small. Electrical connectors are used in a variety of applications. One type of connector is commonly known as a board-to-board connector for interconnecting two circuit boards. A board-to-board connector typically includes interengageable male and female connectors. Referring to FIG. 1, the electrical connector 10 comprises an insulative housing 8, a plurality of signal and grounding contacts 71, 72 received in the insulative housing, and a shell assembled to exterior surfaces of the insulative housing. Two outsides 93 of shell are cantilever-shaped. In such a way, when the electrical connector is received an unsuitable force, the two outsides 93 will move upwardly and will contact soldering portions 710 of the signal contacts. Therefore, an electrical short circuit will be existed between the shell and the signal contacts to effect qualities of electrical performance.

Hence, an improved electrical connector is required to overcome the disadvantages of the prior art.

SUMMARY OF THE INVENTION

A major object of the present invention is to provide an improved structure of a shell for preventing an electrical short circuit between the shell and signal contacts.

In order to achieve the object set forth, an electrical connector comprises insulative housing, a plurality of contacts, and a shell. The insulative housing has a bottom wall and two side walls extending upwardly from the bottom wall. The contacts include signal contacts and grounding contacts. Each contact has an engaging portion received in the insulative housing and a soldering portion extending outwardly and horizontally from the bottom wall. The shell is assembled to outer surfaces of the side walls and comprises a plurality of grounding fingers and a pair of cut portions. A distant is existed between a bottom surface of the bottom wall and each cut portion.

Other objects, advantages and novel features of the invention will become more apparent from the following detailed description when taken in conjunction with the accompanying drawings.

DETAILED DESCRIPTION OF THE INVENTION

Figure 1:
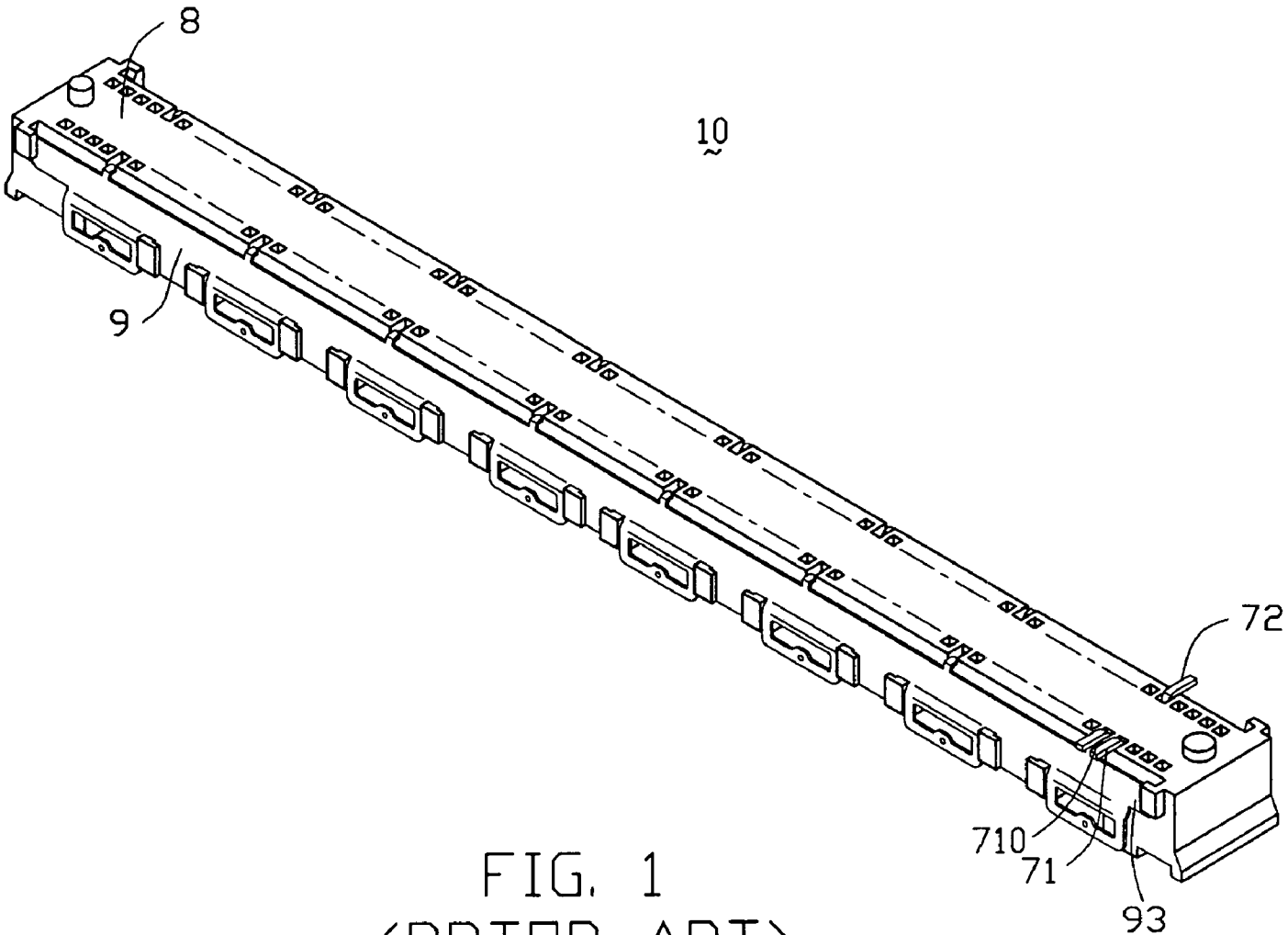
FIG. 1 is an assembled, perspective view of a prior art electrical connector.
Figure 2:
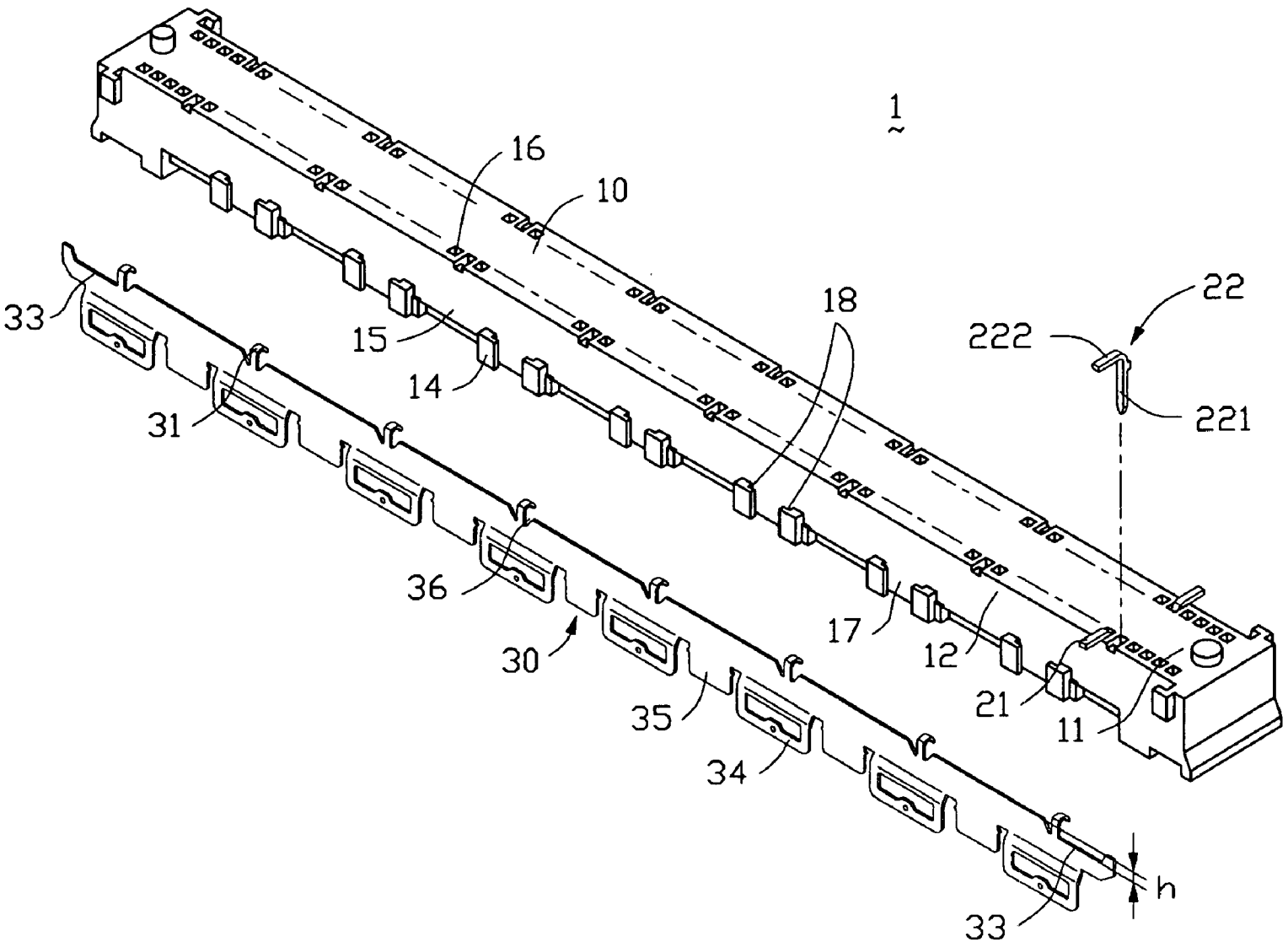
FIG. 2 is an exploded, perspective view of an electrical connector in accordance with the present invention.
Figure 3:
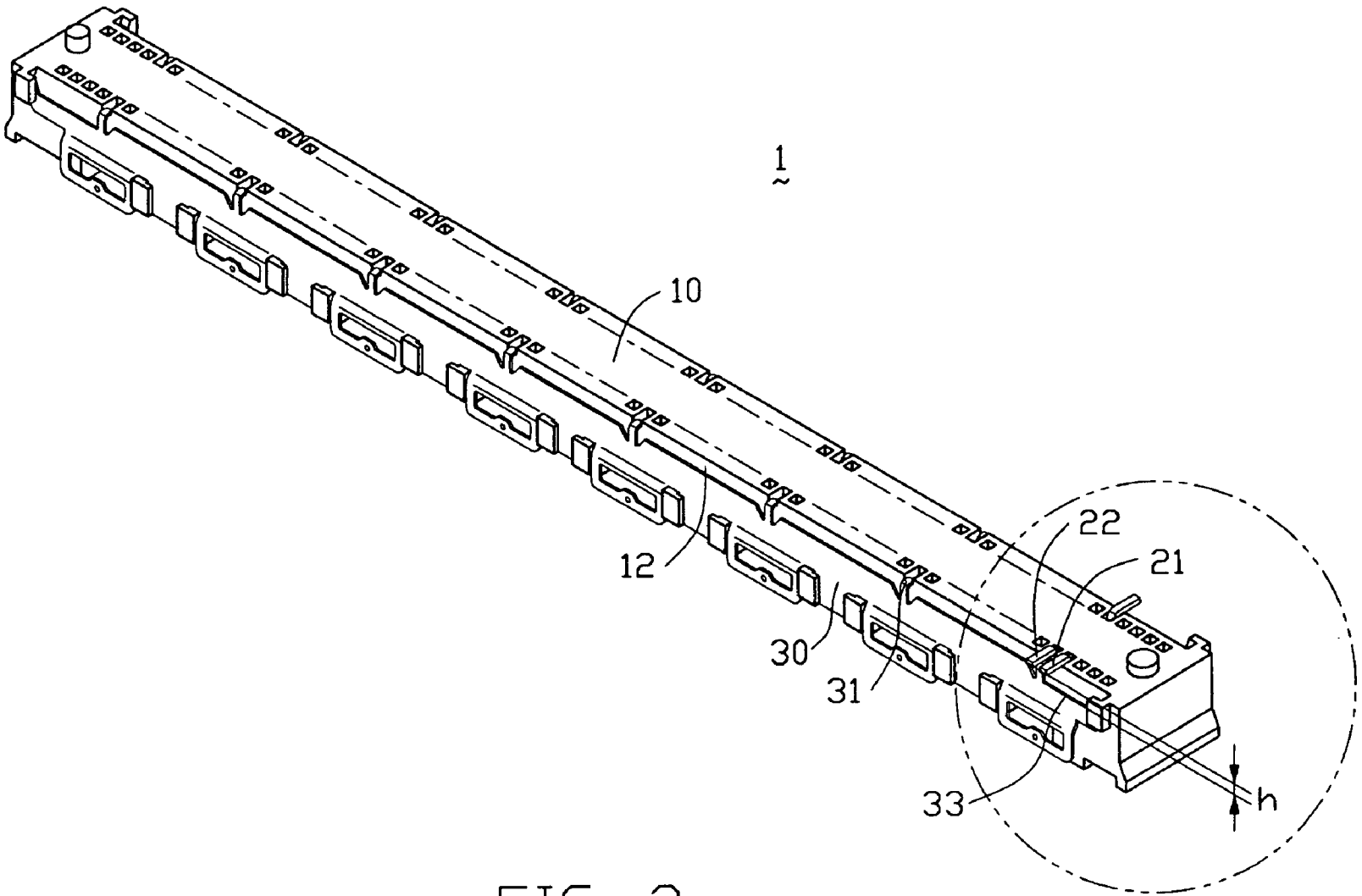
FIG. 3 is an assembled, perspective view of the electrical connector of FIG. 1.

Referring to FIGS. 2 and 3, an electrical connector 1 comprises an insulative housing 10, a plurality of contacts 20, and a shell 30.

The insulative housing 10 is elongate and comprises a bottom wall 11 and opposite side walls 12 extending upwardly from the bottom wall 11. The insulative housing 10 defines a plurality of passageways 16 for receiving the contacts 20. Each side wall 12 forms a plurality of pairs of protrusions 14 on an exterior surface. Each pair of protrusions 14 define a pair of channels 18 facing to each other and a recess 17 therebetween. A partition 15 is formed between every two pairs of the protrusions 14.

The contacts 20 include a plurality of signal contacts 21 and grounding contacts 22. Each contact 21, 22 comprises an engaging portion 221 received in the insulative housing 10 and a soldering portion 222 extending outwardly and horizontally from a bottom wall 11 of the insulative housing 10.

Figure 4:
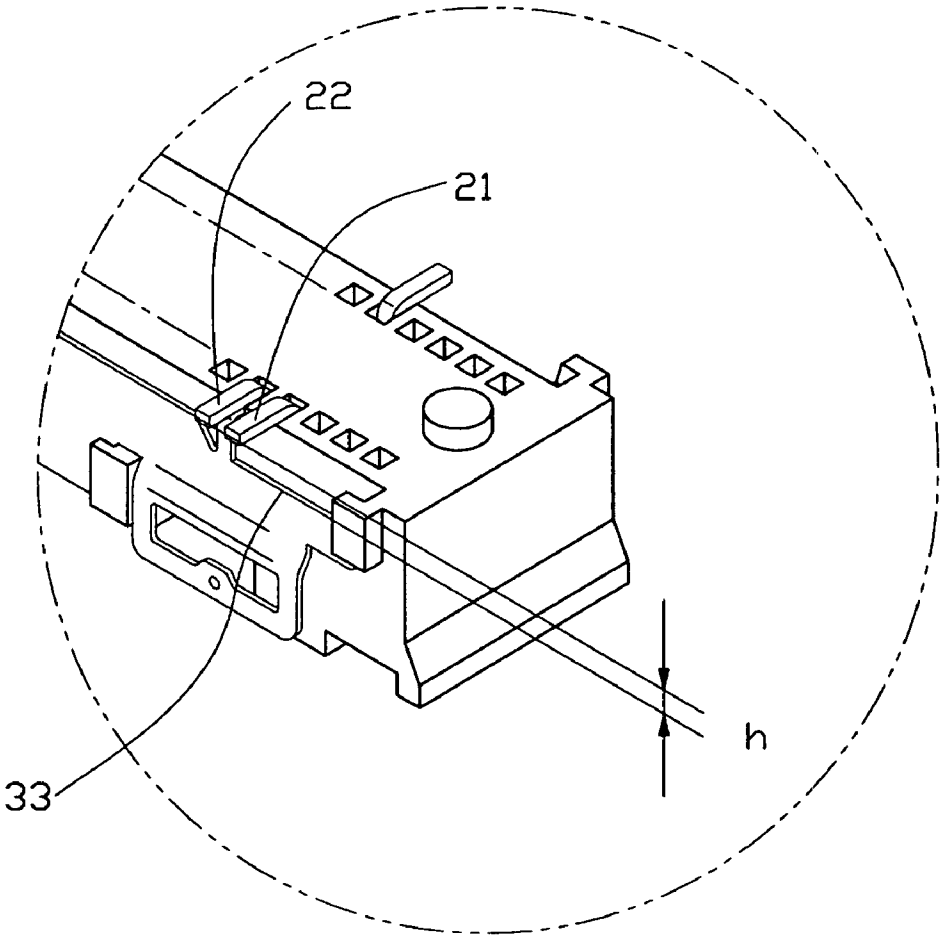
FIG. 4 is a partly enlarged view of the electrical connector of FIG. 2.

Referring to FIGS. 2 to 4, the shell 30 is assembled to the exterior surfaces of the side walls 12 and includes a plurality of grounding fingers 31 received in corresponding cavities 130 of the bottom wall 11 for achieving an mechanical and an electrical connections with the grounding contacts 22. The cavities 130 communicate with the passageways 16 and receive the grounding contacts 22. A pair of V-shaped openings 36 is defined at two sides of each grounding finger 31. The shell 30 further includes a plurality of hollow arms 34 extending along a direction opposite to the grounding fingers 31. A retention arm 35 is formed between every two hollow arms 34 and is positioned in the recess 17 for securing the shell 30 with the side walls 12. A pair of cut portions 33 at two outer sides of the shell 30 are cantilever-shaped and correspond to the signal contacts 21. A distant between each cut portion 33 of the shell 30 and a bottom surface of the bottom wall 11 of the insulative housing 10 is h.

In assembly, the grounding fingers 31 are first assembled to the passageways 16 and the grounding contacts 22 are inserted into the same passageways 16 to retain the grounding fingers 31 for limiting a perpendicular movement of the shell 30. Each hollow arm 34 is received in the partition 15 of the insulative housing 10. The retention arms 35 each inserts into the recess 17 along the channels 18 of the protrusions 14.

The cut portions 33 of the shell 30 of the present invention can provide function to prevent the shell 30 and the signal contacts 21 making an electrical short circuit. When the shell 30 is received an unsuitable force, the shell 30 will move toward the soldering portions 222 of the signal contacts 21. Due to the h distant between the cut portion 33 and the bottom surface of the bottom wall 11, the cut portion 33 will not contact the signal contacts 21. Thus, the electrical short circuit between the shell 30 and the signal contacts 21 will not be happen.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing extending in a longitudinal direction and defining a pair of side external faces and a bottom face along said longitudinal direction;

a plurality of contacts disposed in the housing, each of the contacts defining a surface mounting tails around the bottom face;

a plurality of protrusions formed on at least one of the side external faces;

a metal shell attached to said at least one of the side external faces by means of said protrusions; wherein a bottom edge section of said metal shell is upwardly recessed, around at least one of a distal end section thereof along said longitudinal direction, to be spaced from the corresponding surface mounting tails with a distance larger than that between other portions of the bottom edge section thereof and the corresponding surface mounting tails in a vertical direction for avoid electrically shorting;

wherein said distal end section extends in a cantilever manner along said longitudinal direction;

wherein said shell further includes a plurality of grounding fingers downwardly extending from the bottom edge section in said vertical direction between two distal ends of thereof.

* * * * *